US009322256B2

(12) United States Patent
Wright et al.

(10) Patent No.: US 9,322,256 B2
(45) Date of Patent: Apr. 26, 2016

(54) RF ANTENNA ASSEMBLY WITH DIELECTRIC ISOLATOR AND RELATED METHODS

(71) Applicant: HARRIS CORPORATION, Melbourne, FL (US)

(72) Inventors: Brian Wright, Indialantic, FL (US); Murray Hann, Malabar, FL (US); Raymond Hewit, Palm Bay, FL (US); Verlin Hibner, Melbourne Beach, FL (US)

(73) Assignee: HARRIS CORPORATION, Melbourne, FL (US)

( * ) Notice: Subject to any disclaimer, the term of this patent is extended or adjusted under 35 U.S.C. 154(b) by 348 days.

(21) Appl. No.: 13/804,119

(22) Filed: Mar. 14, 2013

(65) Prior Publication Data

US 2014/0262223 A1 Sep. 18, 2014

(51) Int. Cl.

| | |
|---|---|
| ***E21B 43/00*** | (2006.01) |
| ***E21B 36/00*** | (2006.01) |
| ***E21B 43/24*** | (2006.01) |
| ***E21B 47/12*** | (2012.01) |
| ***E21B 36/04*** | (2006.01) |

(52) U.S. Cl.

CPC ..... *E21B 43/2401* (2013.01); *E21B 36/04* (2013.01); *E21B 47/122* (2013.01)

(58) Field of Classification Search

CPC .... E21B 47/122; E21B 43/2401; E21B 36/04
USPC ..... 166/57, 60, 248
See application file for complete search history.

(56) References Cited

U.S. PATENT DOCUMENTS

| | | | |
|---|---|---|---|
| 2,187,584 | A | 1/1940 | Gothe |
| 2,351,520 | A | 6/1944 | Katzin |
| 2,795,397 | A | 6/1957 | Hull et al. |
| 3,496,496 | A | 2/1970 | Fiebel |
| 3,716,652 | A | 2/1973 | Lusk et al. |
| 3,813,479 | A | 5/1974 | Olivero |
| 4,012,092 | A | 3/1977 | Godbey |
| 4,207,574 | A | 6/1980 | Toia |
| 4,359,743 | A | 11/1982 | DeSantis |

(Continued)

FOREIGN PATENT DOCUMENTS

| | | |
|---|---|---|
| WO | 2013192124 | 12/2013 |
| WO | 2014160137 | 10/2014 |

OTHER PUBLICATIONS

Wright et al., U.S. Appl. No. 14/024,875, filed Sep. 12, 2013.

(Continued)

*Primary Examiner* — Kenneth L Thompson
*Assistant Examiner* — Michael Wills, III
(74) *Attorney, Agent, or Firm* — Allen, Dyer, Doppelt, Milbrath & Gilchrist, P.A. Attorneys at Law

(57) ABSTRACT

An RF antenna assembly is positioned within a wellbore in a subterranean formation for hydrocarbon resource recovery. The RF antenna assembly includes first and second tubular conductors and a dielectric isolator therebetween. The dielectric isolator includes a dielectric tube having opposing first and second open ends, a first tubular connector having a first slotted recess receiving therein the first open end of the dielectric tube, and a second tubular connector having a second slotted recess receiving therein the second open end of the dielectric tube.

28 Claims, 15 Drawing Sheets

(56) References Cited

U.S. PATENT DOCUMENTS

| | | | | |
|---|---|---|---|---|
| 4,498,086 | A | 2/1985 | Sandler | |
| 4,543,548 | A | 9/1985 | Seal | |
| 4,583,589 | A | 4/1986 | Kasevich | |
| 4,647,941 | A | 3/1987 | Myer | |
| 4,660,910 | A | 4/1987 | Sharp | |
| 5,065,819 | A | 11/1991 | Kasevich | |
| 5,068,672 | A | 11/1991 | Onnigian et al. | |
| 5,109,927 | A | 5/1992 | Supernaw et al. | |
| 5,455,548 | A | 10/1995 | Grandchamp et al. | |
| 5,568,161 | A | 10/1996 | Fulmer, Sr. | |
| 5,617,105 | A | 4/1997 | Tsunekawa et al. | |
| 5,751,895 | A * | 5/1998 | Bridges | 392/306 |
| 6,154,179 | A | 11/2000 | Kohno | |
| 6,189,611 | B1 | 2/2001 | Kasevich | |
| 6,415,869 | B1 | 7/2002 | Smith | |
| 6,681,861 | B2 | 1/2004 | Davidson et al. | |
| 6,712,644 | B1 | 3/2004 | DeCormier | |
| 6,720,934 | B1 | 4/2004 | Price et al. | |
| 6,771,227 | B2 | 8/2004 | Tsai et al. | |
| 7,055,599 | B2 | 6/2006 | Kasevich | |
| 7,239,286 | B1 | 7/2007 | Miller et al. | |
| 7,404,725 | B2 | 7/2008 | Hall | |
| 7,441,597 | B2 | 10/2008 | Kasevich | |
| 7,488,194 | B2 | 2/2009 | Hall et al. | |
| 7,891,421 | B2 | 2/2011 | Kasevich | |
| 7,962,288 | B2 | 6/2011 | Gleitman | |
| 8,003,014 | B2 | 8/2011 | Breay et al. | |
| 8,128,786 | B2 | 3/2012 | White et al. | |
| 8,556,656 | B2 | 10/2013 | Thomas | |
| 8,847,711 | B2 | 9/2014 | Wright et al. | |
| 8,969,722 | B2 | 3/2015 | Bonn | |
| 9,016,367 | B2 | 4/2015 | Wright | |
| 9,157,305 | B2 | 10/2015 | Dittmer | |
| 2002/0093431 | A1 | 7/2002 | Zierolf | |
| 2002/0189817 | A1 | 12/2002 | Davidson et al. | |
| 2003/0032339 | A1 | 2/2003 | Bell et al. | |
| 2005/0199386 | A1 | 9/2005 | Kinzer | |
| 2005/0200498 | A1 | 9/2005 | Gleitman | |
| 2007/0187089 | A1 | 8/2007 | Bridges | |
| 2008/0166917 | A1 | 7/2008 | Hall et al. | |
| 2009/0272576 | A1 | 11/2009 | Medina | |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2012/0012219 | A1 | 1/2012 | Breay et al. | |
| 2012/0176138 | A1 | 7/2012 | Prammer | |
| 2013/0048278 | A1 | 2/2013 | Parsche et al. | |
| 2013/0180729 | A1 | 7/2013 | Wright et al. | |
| 2013/0334205 | A1 | 12/2013 | Wright | |
| 2014/0041890 | A1 | 2/2014 | Wright | |
| 2014/0224472 | A1 * | 8/2014 | Parsche | 166/60 |
| 2014/0262222 | A1 | 9/2014 | Wright et al. | |
| 2014/0262224 | A1 | 9/2014 | Ayers et al. | |

OTHER PUBLICATIONS

Wright et al., U.S. Appl. No. 14/034,889, filed Sep. 24, 2013.

"Drill Faster, Farther, Deeper," Aluminum Drill Pipe, Inc. brochure (Addendum Feb. 28, 2008), pp. 1-11.

* cited by examiner

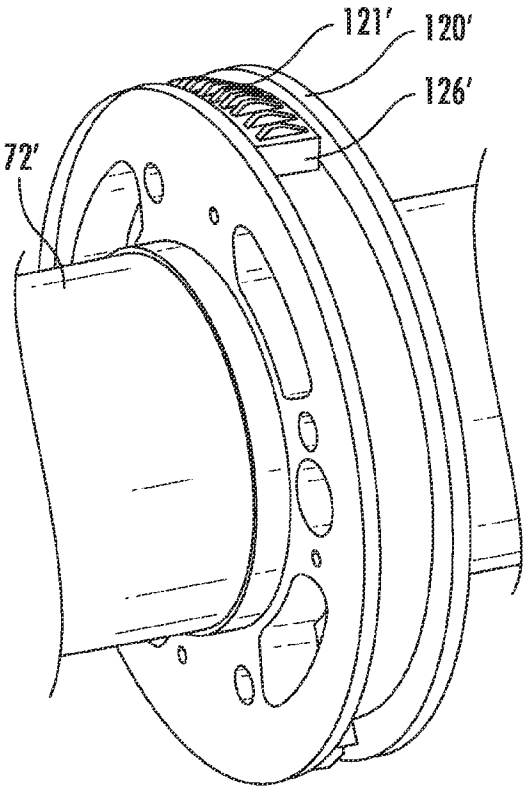
FIG. 13A
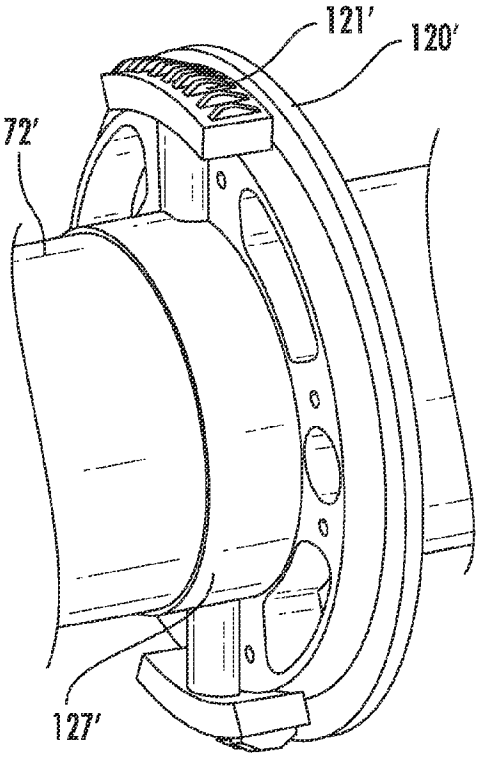
FIG. 13B
FIG. 13C

RF ANTENNA ASSEMBLY WITH DIELECTRIC ISOLATOR AND RELATED METHODS

FIELD OF THE INVENTION

The present invention relates to the field of hydrocarbon resource processing, and, more particularly, to an antenna assembly isolator and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale. While RF heating may address some of these shortcomings, further improvements to RF heating may be desirable. For example, it may be relatively difficult to install or integrate RF heating equipment into existing wells.

SUMMARY OF THE INVENTION

In view of the foregoing background, it is therefore an object of the present invention to provide a dielectric isolator that is physically robust and flexible.

This and other objects, features, and advantages in accordance with the present invention are provided by an RF antenna assembly configured to be positioned within a wellbore in a subterranean formation for hydrocarbon resource recovery. The RF antenna assembly comprises first and second tubular conductors and a dielectric isolator therebetween. The dielectric isolator comprises a dielectric tube having opposing first and second open ends, a first tubular connector comprising a first slotted recess receiving therein the first open end of the dielectric tube, and a second tubular connector comprising a second slotted recess receiving therein the second open end of the dielectric tube. Advantageously, the dielectric isolator is mechanically robust and electrically efficient.

More specifically, the dielectric tube may have a first plurality of passageways therein adjacent the first open end and through the first slotted recess, and a second plurality of passageways therein adjacent the second open end and through the second slotted recess. The first tubular connector may have a first plurality of blind openings therein aligned with the first plurality of passageways, and the second tubular connector may have a second plurality of blind openings therein aligned with the second plurality of passageways.

In some embodiments, the RF antenna assembly may further comprise a first plurality of pins extending through the first pluralities of passageways and blind openings, and a second plurality of pins extending through the second pluralities of passageways and blind openings. The RF antenna assembly further may comprise adhesive securing the first and second tubular connectors to the respective first and second open ends.

Additionally, the first tubular connector may have a first threaded surface for engaging an opposing threaded end of the first tubular conductor, and the second tubular connector may have a second threaded surface for engaging an opposing threaded end of the second tubular conductor. The first tubular connector may have a first plurality of tool-receiving recesses on a first outer surface thereof, and the second tubular connector may have a second plurality of tool-receiving recesses on a second outer surface thereof.

For example, the dielectric tube may comprise cyanate ester composite material. The dielectric isolator may further comprise at least one inner conductor extending within the dielectric tube.

Another aspect is directed to a method of assembling an RF antenna assembly within a wellbore in a subterranean formation for hydrocarbon resource recovery. The method comprises coupling first and second tubular conductors and a dielectric isolator therebetween. The dielectric isolator comprises a dielectric tube having opposing first and second open ends, a first tubular connector comprising a first slotted recess receiving therein the first open end of the dielectric tube, and a second tubular connector comprising a second slotted recess receiving therein the second open end of the dielectric tube.

BRIEF DESCRIPTION OF THE DRAWINGS

FIGS. 13A-13C are perspective views of the coupling structure of FIG. 10 during steps of assembly.

FIGS. 16A-168 are a Smith Chart and a permittivity diagram, respectively, of an example embodiment of the antenna assembly of FIG. 7.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
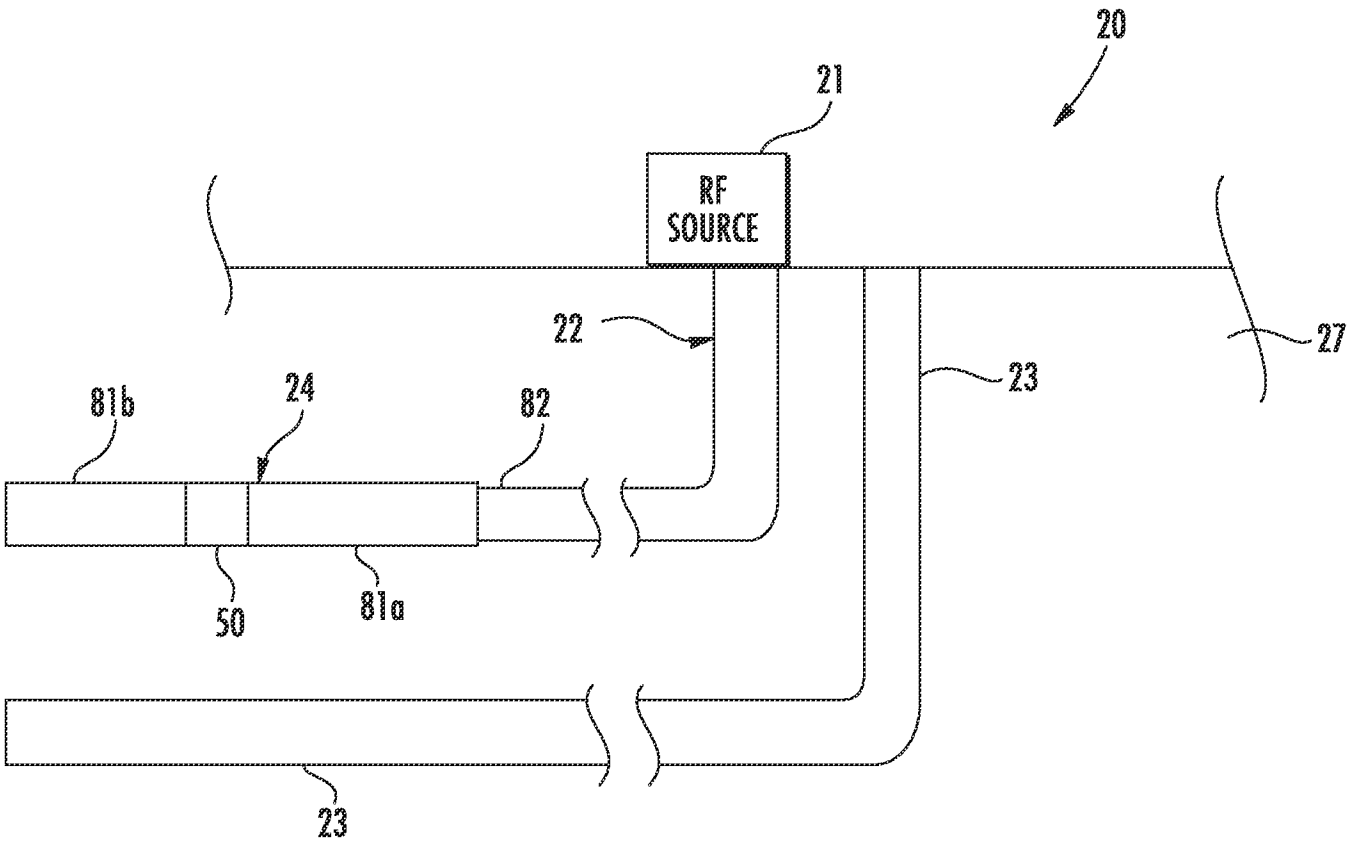
FIG. 1 is a schematic diagram of an antenna assembly in a subterranean formation, according to the present invention.
Figure 2:
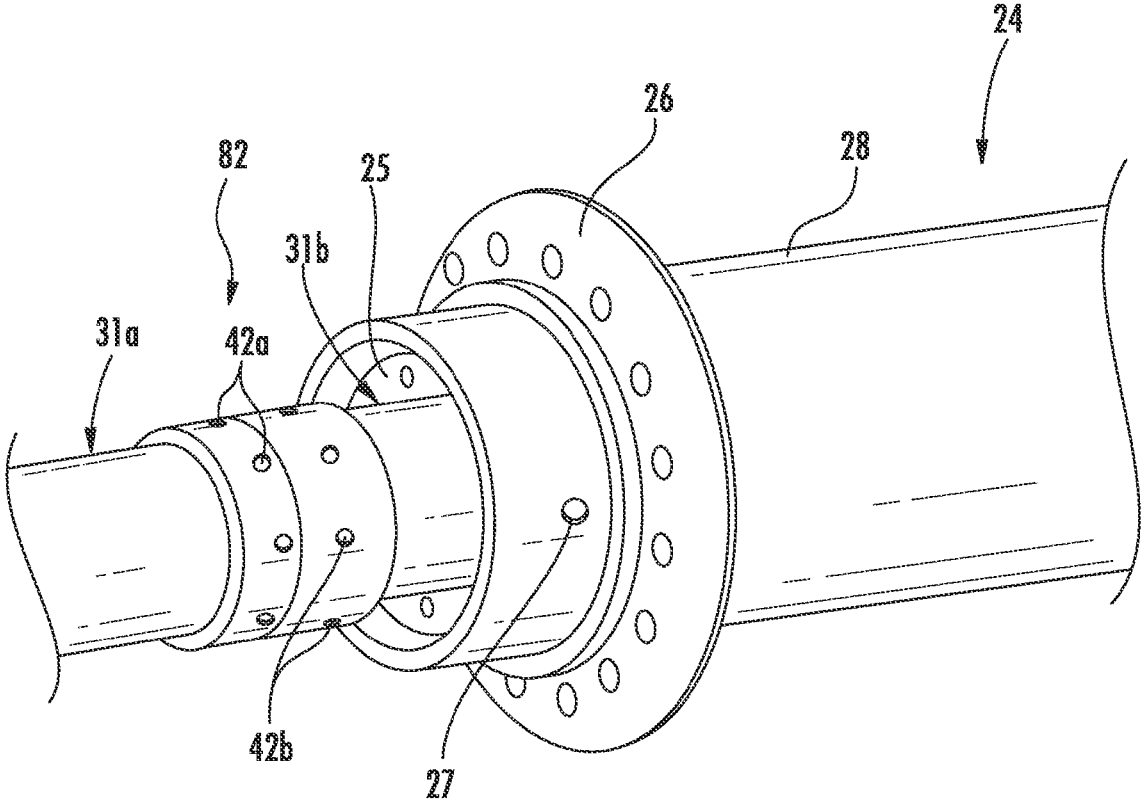
FIG. 2 is a perspective view of adjacent coupled RF coaxial transmission lines in the antenna assembly of FIG. 1.
Figure 3:
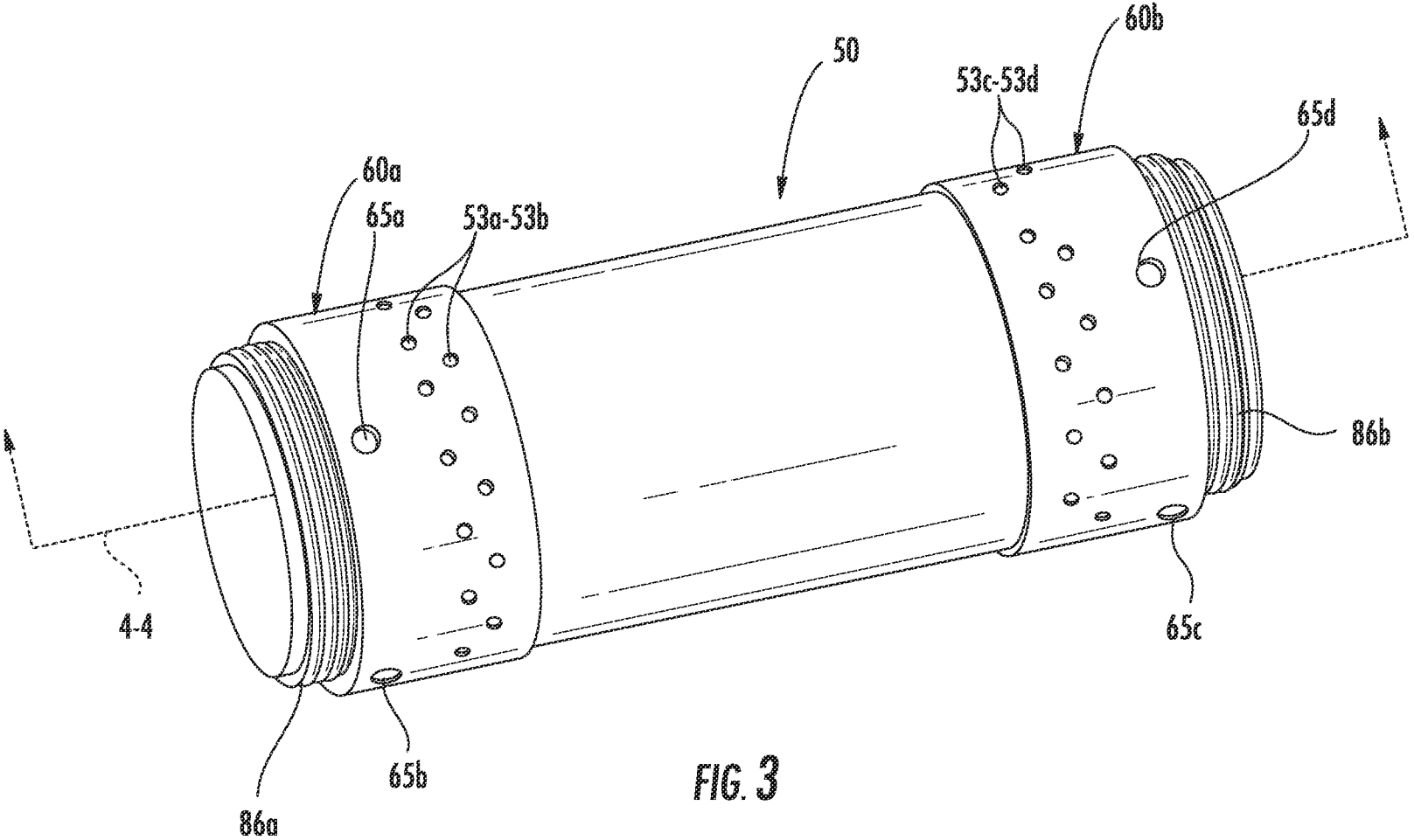
FIG. 3 is a perspective view of the feed connector (dielectric isolator) from the antenna assembly of FIG. 1 with the first and second tubular conductors and RF transmission line removed.
Figure 4:
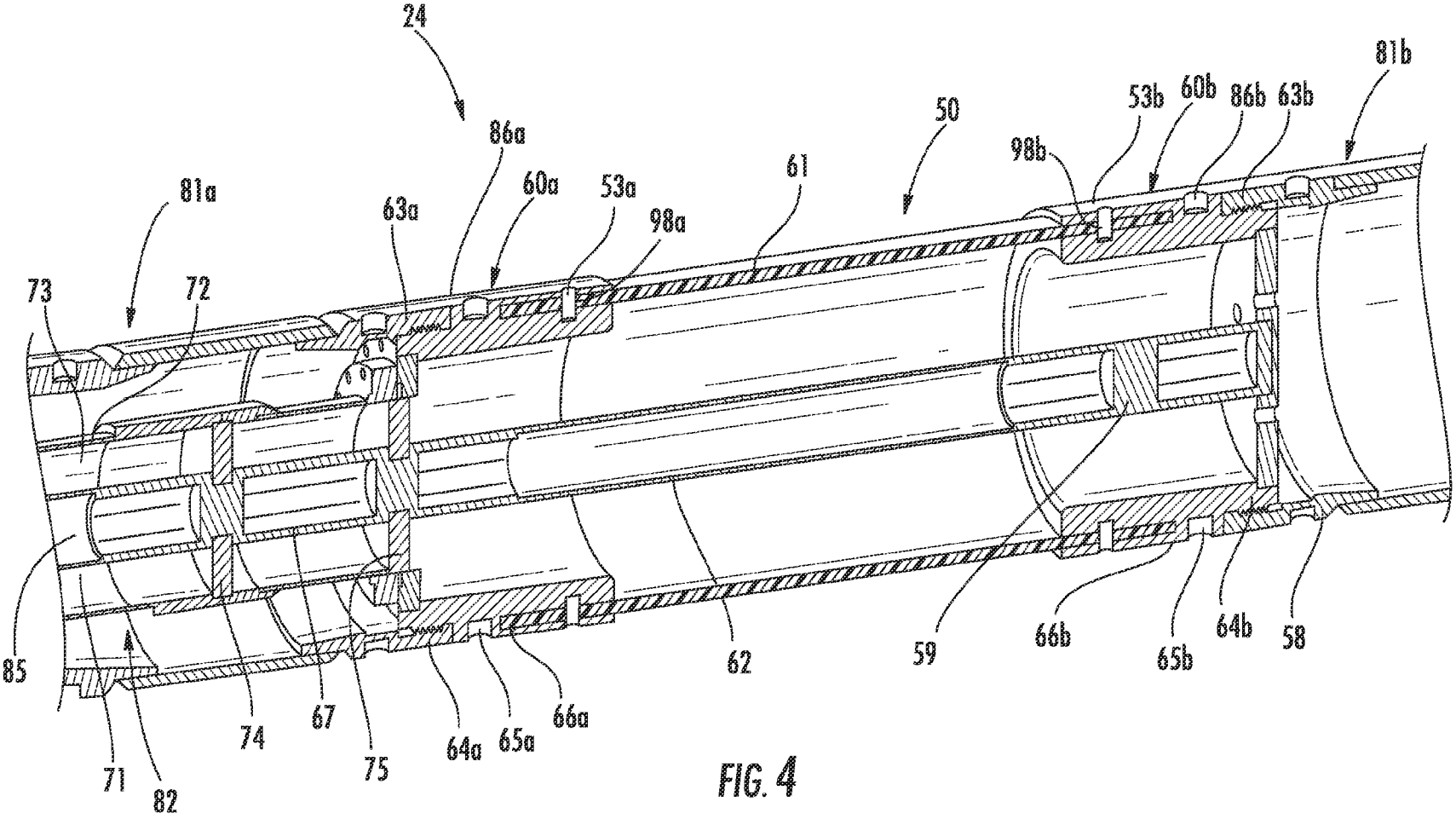
FIG. 4 is a cross-sectional view along line 4-4 of a portion of the feed connector FIG. 3 with the first and second tubular conductors and RF transmission line added.

Referring initially to FIGS. 1-2, a hydrocarbon recovery system 20 according to the present invention is now described. The hydrocarbon recovery system 20 includes an injector well 22, and a producer well 23 positioned within respective wellbores in a subterranean formation 27 for hydrocarbon recovery. The injector well 22 includes an antenna assembly 24 at a distal end thereof. The hydrocarbon recovery system 20 includes an RF source 21 for driving the antenna assembly 24 to generate RF heating of the subterranean formation 27 adjacent the injector well 22.

The antenna assembly 24 comprises a tubular antenna element 28, for example, a center fed dipole antenna, positioned within one of the wellbores, and a RF coaxial transmission line positioned within the tubular antenna element. The RF coaxial transmission line comprises a series of coaxial sections 31*a*-31*b* coupled together in end-to-end relation. The tubular antenna element 28 also includes a plurality of tool-receiving recesses 27 for utilization of a torque tool in assembly thereof. The coaxial sections 31*a*-31*b* also include a plurality of tool-receiving recesses 42*a*-42*b*.

The antenna assembly 24 includes a dielectric spacer 25 between the tubular antenna element 28 and the RF coaxial transmission line 31*a*-31*b*, and a dielectric spacer 26 for serving as a centering ring for the antenna assembly 24 while in the respective wellbore.

Referring now additionally to FIGS. 3-5B, the RF antenna assembly 24 comprises first and second tubular conductors 81*a*-81*b*, and a feed structure 50 therebetween defining a dipole antenna positioned within the respective wellbore. The RF transmission line 82 extends within one of the tubular conductors 81*a*. The feed structure 50 comprises a dielectric tube 61, a first connector 60*a* coupling the RF transmission line 82 to the first tubular conductor 81*a*, and a second connector 60*b* coupling the RF transmission line to the second tubular conductor 81*b*. For example, the dielectric tube 61 may comprise a cyanate ester composite material (e.g. quartz enhanced) or another suitable dielectric composite that has mechanical strength for structural integrity, and absorbs minimal amounts of radiated energy.

More specifically, the RF transmission line 82 may comprise a series of coaxial sections coupled together in end-to-end relation, each coaxial section comprising an inner conductor 71, an outer conductor 72 surrounding the inner conductor, and a dielectric therebetween. The first connector 60*a* couples the outer conductor 72 to the first tubular conductor 81*a*, and the second connector 60*b* couples the inner conductor 71 to the second tubular conductor 81*b*. In the illustrated embodiment, the first and second connectors 60*a*-60*b* include a plurality of tool-receiving recesses 65*a*-65*d* on an outer surface thereof. The tool-receiving recesses 65*a*-65*d* are illustratively circular in shape, but in other embodiments, may comprise other shapes, such as a hexagon shape. The tool-receiving recesses 65*a*-65*d* are provided to aid in using torque wrenches in assembling the antenna assembly 24. As perhaps best seen in FIG. 4, the RF transmission line 82 is affixed to the first connector 60*a* with a plurality of bolts. Of course, other fasteners may be used.

In the illustrated embodiment, the inner conductor 71 comprises a tube defining a first fluid passageway 85 therein (e.g. for the flow of cooling fluid/gas in). The outer conductor 72 is illustratively spaced from the inner conductor 71 to define a second fluid passageway 73 (e.g. for cooling/gas out fluid). The second fluid passageway 73 defines the dielectric between the inner conductor 71 and the outer conductor 72 with either air or cooling fluid/gas. The passageways 85, 73 permit the flow of selective gases and fluids that aid in the hydrocarbon recovery process.

The feed structure 50 includes an intermediate conductor 62 extending within the dielectric tube 61 and coupling the inner conductor 71 to the second connector 60*b*. For example, the intermediate conductor 62 illustratively comprises a conductive tube (of a material comprising, e.g., copper, aluminum). Moreover, the RF transmission line 82 includes an inner conductor coupler 67 for coupling the inner conductor 71 to the intermediate conductor 62, and first and second dielectric spacers 74-75, each comprising a bore therein for receiving the inner conductor coupler. The first and second dielectric spacers 74-75 are shown without fluid openings, but in other embodiments (FIG. 6), they may include them, thereby permitting the flow of fluids within the dielectric tube 61. Advantageously, the inner conductor coupler 67 accommodates differential thermal expansion. Additionally, the first and second tubular conductors 81*a*-81*b* each comprises a threaded end 63*a*-63*b*, and the first and second connectors 60*a*-60*b* each comprises a threaded end 86*a*-86*b* engaging a respective threaded end of the first and second tubular conductors for defining overlapping mechanical threaded joints 64*a*-64*b*. The threaded ends 63*a*-63*b* of the first and second tubular conductors 81*a*-81*b* each comprises a mating face adjacent the first and second connectors 60*a*-60*b*. The mating face includes a threading relief recess to provide good contact at the outer extreme of the first and second connectors 60*a*-60*b*. The overlapping mechanical threaded joints 64*a*-64*b* provide for a hydraulic seal that seals in fluid and gases within the antenna assembly 24.

Figure 6:
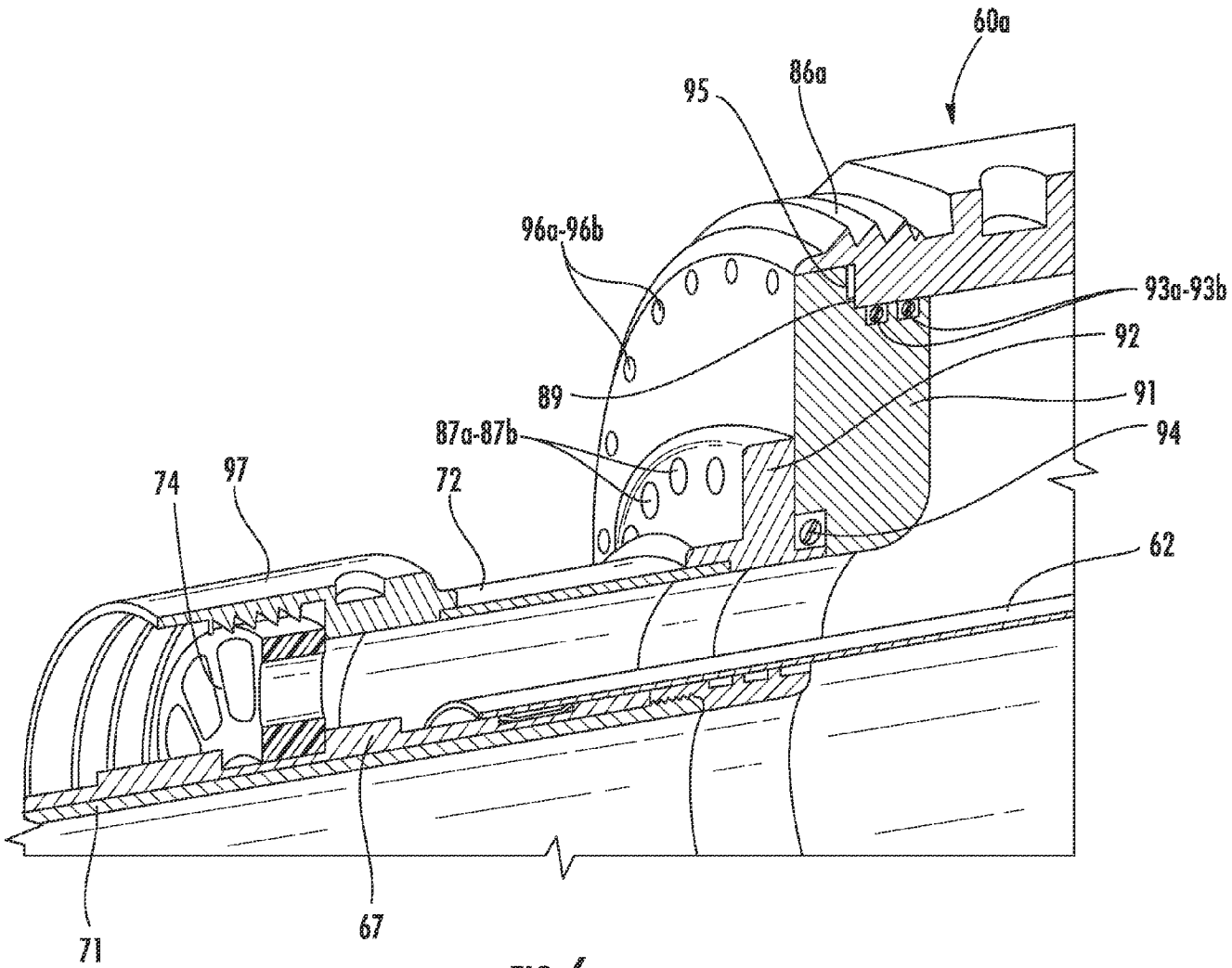
FIG. 6 is another enlarged portion of the cross-sectional view of FIG. 4 with the second tubular conductor and second dielectric spacer removed.

The second connector 60*b* illustratively includes an interface plate 58 mechanically coupled thereto, via fasteners, and another inner conductor coupler 59. The interface plate 58 illustratively includes openings (slits) therein for permitting the controlled flow of coolant. In some embodiments, the coolant would flow from the inner conductor coupler 59 through the dielectric tube 61 and return to the second fluid passageway 73. In these embodiments, the first and second dielectric spacers 74-75 each include openings therein for providing the flow (FIG. 6).

Figure 5A:
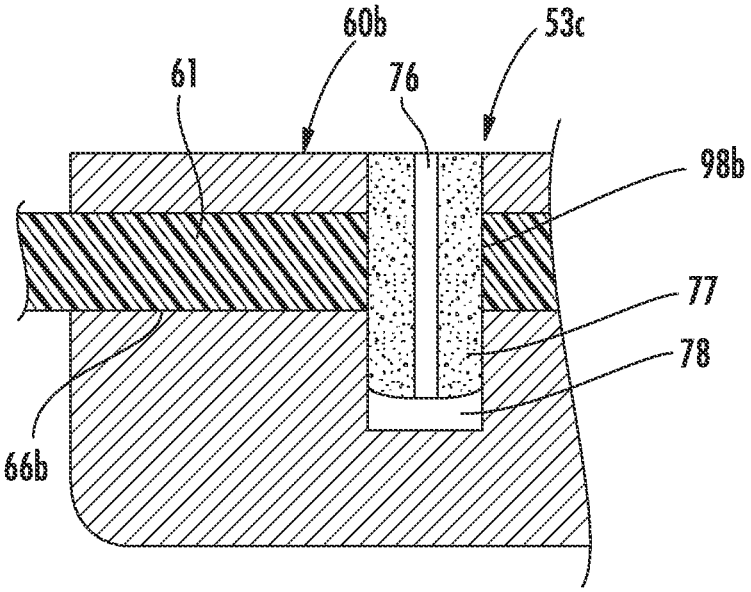
FIG. 5A is an enlarged portion of the cross-sectional view of FIG. 4.
Figure 5B:
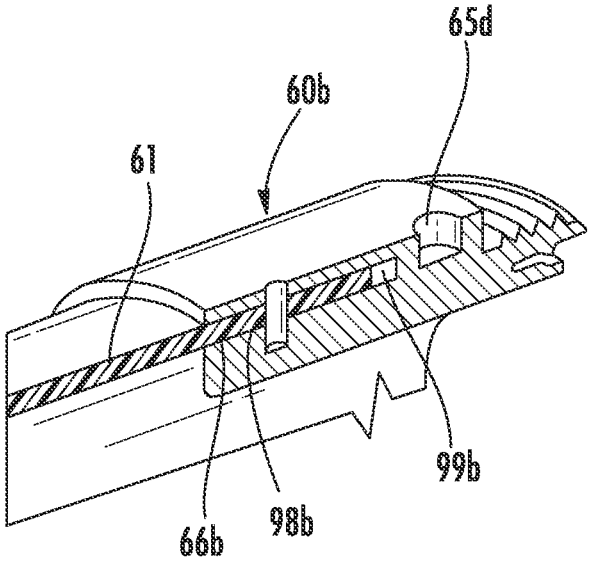
FIG. 5B is an enlarged portion of the cross-sectional view of FIG. 4 with the second tubular conductor removed.

As perhaps best seen in FIGS. 5A and 5B, each of the first and second connectors 60*a*-60*b* comprises a recess 66*a*-66*b* for receiving adjacent portions of the dielectric tube 61. In the illustrated embodiment, each recess comprises a circular slot that is circumferential with regards to the first and second connectors 60*a*-60*b*. Moreover, all edges in the illustrated embodiment are rounded, which helps to reduce arching in high voltage (HV) applications.

In one embodiment, the dielectric tube 61 is affixed to each of the first and second connectors 60*a*-60*b* with a multi-step process. First, the recesses 66*a*-66*b* are primed for bonding, and then an adhesive material 99*b*, such as an epoxy (e.g. EA9494(Hysol EA 9394 high temperature epoxy adhesive, other similar high temperature adhesives can be used. This provides stability and strength in the bonded joint.)), is placed therein. Thereafter, the first and second connectors 60*a*-60*b* and the dielectric tube 61 are drilled to create a plurality of spaced apart blind passageways 53*a*-53*b*, i.e. the drill hole does not completely penetrate the first and second connectors. The passageways 53*a*-53*b* are then reamed, and for each passageway, a pin 78 is placed therein. The passageways 53*a*-53*b* are then filled with an epoxy adhesive 77, such as Sylgard 186, as available from the Dow Corning Corporation of Midland, Michigan, and then the surface is fly cut to provide a smooth surface. The epoxy adhesive 77 forces out air pockets and insures structural integrity. A high-temp adhesive, such as Loctite 609 (for cylindrical assemblies), is applied just prior to assembly of the pin 78 in the passageway 53*a*-53*b*, and an axial hole 76 in the pin allows gasses to escape on assembly.

Advantageously, the feed structure 50 isolates the first and second tubular conductors 81*a*-81*b* of the dipole antenna, thereby preventing arching for high voltage applications in a variety of environmental conditions. Moreover, the feed structure 50 is mechanically robust and readily supports the antenna assembly 24. The dielectric tube 61 has a low power factor (i.e. the product of the dielectric constant and the dissipation factor), which inhibits dielectric heating of the feed structure 50. Moreover, the materials of the feed structure 50 have long term resistance to typical oil field chemicals, providing for reliability and robustness, and have high temperature survivability without significant degradation of the desirable properties.

In another embodiment, the feed structure 50 may include a ferromagnetic tubular balun extending through the RF transmission line 82 and to the dielectric tube 61, terminating at the balun isolator. The balun surrounds the inner conductor 71 and aids in isolating the inner conductor and reducing common mode current.

Another aspect is directed to a method of making an RF antenna assembly 24 to be positioned within a respective wellbore in a subterranean formation 27 for hydrocarbon resource recovery. The method includes providing first and second tubular conductors 81*a*-81*b* and a feed structure 50 therebetween to define a dipole antenna to be positioned within the respective wellbore, positioning an RF transmission line 82 to extend within one of the tubular conductors

81*a*, and forming the feed structure. The feed structure 50 comprises a dielectric tube 61, a first connector 60*a* coupling the RF transmission line 82 to the first tubular conductor 81*a*, and a second connector 60*b* coupling the RF transmission line to the second tubular conductor 81*b*.

Referring again to FIGS. 1-4, an RF antenna assembly 24 according to the present invention is now described. The RF antenna assembly 24 is configured to be positioned within a wellbore in a subterranean formation 27 for hydrocarbon resource recovery. The RF antenna assembly 24 comprises first and second tubular conductors 81*a*-81*b* and a dielectric isolator 50 therebetween. The dielectric isolator 50 comprises a dielectric tube 61 having opposing first and second open ends, a first tubular connector 60*a* comprising a first slotted recess 66*a* receiving therein the first open end of the dielectric tube, and a second tubular connector 60*b* comprising a second slotted recess 66*b* receiving therein the second open end of the dielectric tube.

More specifically, the dielectric tube includes a first plurality of passageways 98*a* therein adjacent the first open end and through the first slotted recess 66*a*, and a second plurality of passageways 98*b* therein adjacent the second open end and through the second slotted recess 66*b*. The first tubular connector 60*a* includes a first plurality of blind 53*a*-53*b* openings therein aligned with the first plurality of passageways 98*a*, and the second tubular connector 60*b* includes a second plurality of blind openings 53*c*-53*d* therein aligned with the second plurality of passageways 98*b*.

The RF antenna assembly 24 includes a first plurality of pins extending through the first pluralities of passageways and blind openings 98*a*, 53*a*-53*b*, and a second plurality of pins 78 extending through the second pluralities of passageways 98*b* and blind openings 53*c*-53*d*. Although the first plurality of pins is not depicted, the skilled person would appreciate they are formed similarly to the second pins 78. The RF antenna assembly 24 further comprises adhesive 99*b* securing the first and second tubular connectors 60*a*-60*b* to the respective first and second open ends.

Additionally, the first tubular connector 60*a* includes a first threaded surface 86*a* for engaging an opposing threaded end 63*a* of the first tubular conductor, and the second tubular connector 60*b* includes a second threaded surface 86*b* for engaging an opposing threaded end 63*b* of the second tubular conductor. The first tubular connector 60*a* illustratively includes a first plurality of tool-receiving recesses 65*a*-65*b* on a first outer surface thereof, and the second tubular connector 60*b* illustratively includes a second plurality of tool-receiving recesses 65*c*-65*d* on a second outer surface thereof. The dielectric isolator 50 illustratively includes an inner conductor 62 extending within the dielectric tube.

Referring additionally to FIG. 6, the first tubular connector 60*a* illustratively includes an inner interface plate 92 (outer conductor plate), an outer interface plate 91, and an O-ring 94 between the interface plates for providing a tight seal. The first tubular connector 60*a* illustratively includes a pair of O-rings 93*a*-93*b* between the outer interface plate 91 and the first threaded surface 86*a*. The outer interface plate 91 illustratively includes a plurality of circumferential openings 96*a*-96*b*, which each receives fasteners therethrough, such as screws or pins. The pair of O-rings 93*a*-93*b* provides a good seal to control the fluid paths for the cooling oil, and gas paths (as discussed above).

The fasteners physically couple the outer interface plate 91 to the first tubular connector 60*a*. The electrical coupling between the outer interface plate 91 and the first tubular connector 60*a* is at a contact point 89. The coupling also includes a relief recess 95 to generate high force on a defined rim to ensure "metal to metal" contact at a certain pressure, and to guarantee the electrical path. The inner interface plate 92 illustratively includes a plurality of openings 87*a*-87*b* for similarly receiving fasteners to mechanically couple the inner and outer interface plates 91-92 together.

The large number of small fasteners in the inner and outer interface plates 91-92 decreases the radial space for connection, and increases HV standoff distances inside the dielectric isolator 50. Also, the inner and outer interface plates 91-92 have rounded surfaces to increase HV breakdown.

Another aspect is directed to a method of assembling an RF antenna assembly 24 to be positioned within a wellbore in a subterranean formation 27 for hydrocarbon resource recovery. The method comprises coupling first and second tubular conductors 81*a*-81*b* and a dielectric isolator 50 therebetween, the dielectric isolator comprising a dielectric tube 61 having opposing first and second open ends, a first tubular connector 60*a* comprising a first slotted recess 66*a* receiving therein the first open end of the dielectric tube, and a second tubular connector 60*b* comprising a second slotted recess 66*b* receiving therein the second open end of the dielectric tube.

In the illustrated embodiment, the dielectric isolator 50 couples together two dipole element tubular conductors 81*a*-81*b*, but in other embodiments. The tubular connectors 60*a*-60*b* of the dielectric isolator 50 may omit the electrical couplings to the inner conductor 71 and outer conductor 72 of the RF transmission line 82. In these embodiments, the RF transmission line 82 passes through the dielectric isolator 50 for connection further down the borehole, i.e. a power transmission node.

Figure 7:
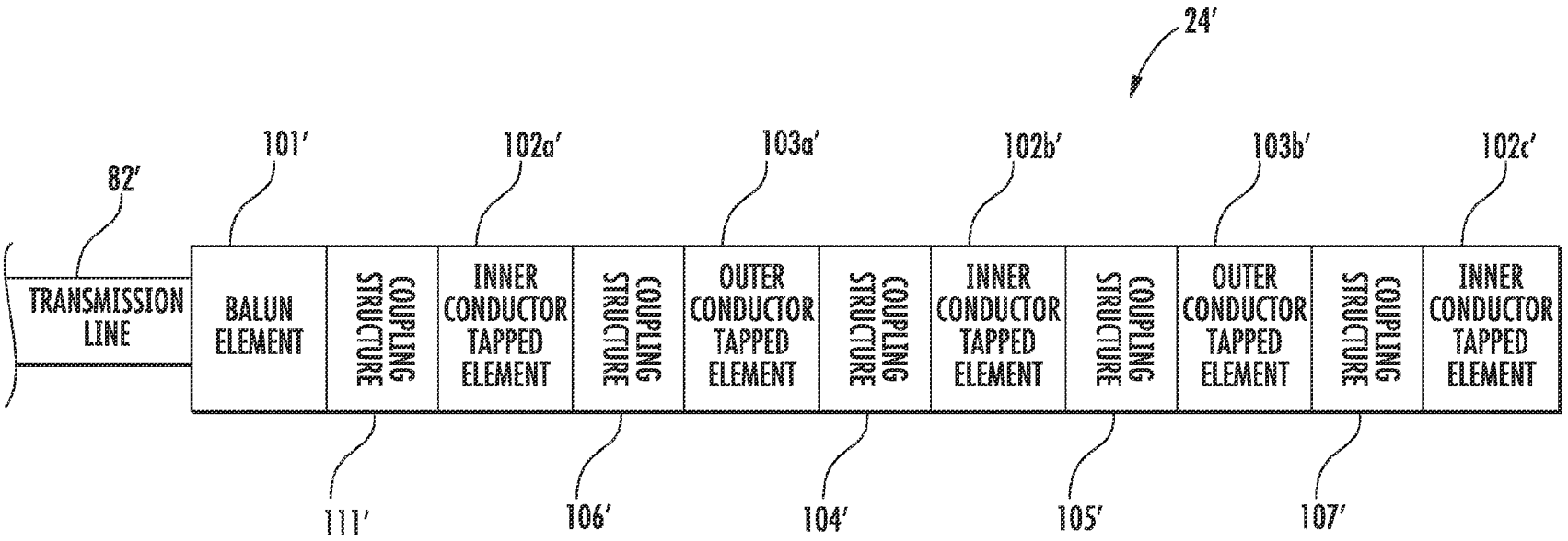
FIG. 7 is a schematic diagram of another embodiment of an RF antenna assembly, according to the present invention.

Referring now additionally to FIG. 7, another embodiment of the RF antenna assembly 24' is now described. In this embodiment of the RF antenna assembly 24', those elements already discussed above with respect to FIGS. 1-6 are given prime notation and most require no further discussion herein. This embodiment differs from the previous embodiment in that this RF antenna assembly 24' includes a series of tubular dipole antennas 102*a*'-102*c*', 103*a*'-103*b*' to be positioned within the wellbore, each tubular dipole antenna comprising a pair of dipole elements 102*a*'-103*a*', 103*a*'-102*b*', 103*b*'-102*c*'. The RF antenna assembly 24' includes an RF transmission line 82' extending within the series of tubular dipole antennas 102*a*'-102*c*', 103*a*'-103*b*', and a respective coupling structure 104'-107', 111' between each pair of dipole elements and between the series of tubular dipole antennas. Each coupling structure 104'-107', 111' comprises a dielectric tube 61' mechanically coupling adjacent dipole elements 102*a*'-103*a*', 103*a*'-102*b*', 103*b*'-102*c*', and a pair of tap connectors 60*a*'-60*b*' carried by the dielectric tube and electrically coupling the RF transmission line 82' to a corresponding dipole element. Additionally, the RF antenna assembly 24' includes $\lambda/2$ dipoles elements 102*a*'-103*a*', 103*a*'-102*b*', 103*b*'-102*c*', and a balun element 101' coupled to the first coupling structure 111'.

More specifically, the RF transmission line 82' comprises an inner conductor 71', an outer conductor 72' surrounding the inner conductor, and a dielectric (e.g. air or cooling fluid) therebetween. The respective coupling structures comprise first 105'-106' and second 104', 107', 111' sets thereof. The tap connectors 60*a*'-60*b*' of the first set of coupling structures 105'-106' electrically couple the outer conductor 72' to the corresponding dipole elements 103*a*'-103*b*'. The tap connectors of the second set of coupling structures 104', 107', 111' electrically couple the inner conductor 71' to the corresponding dipole elements 102*a*'-102*c*'.

Figure 8:
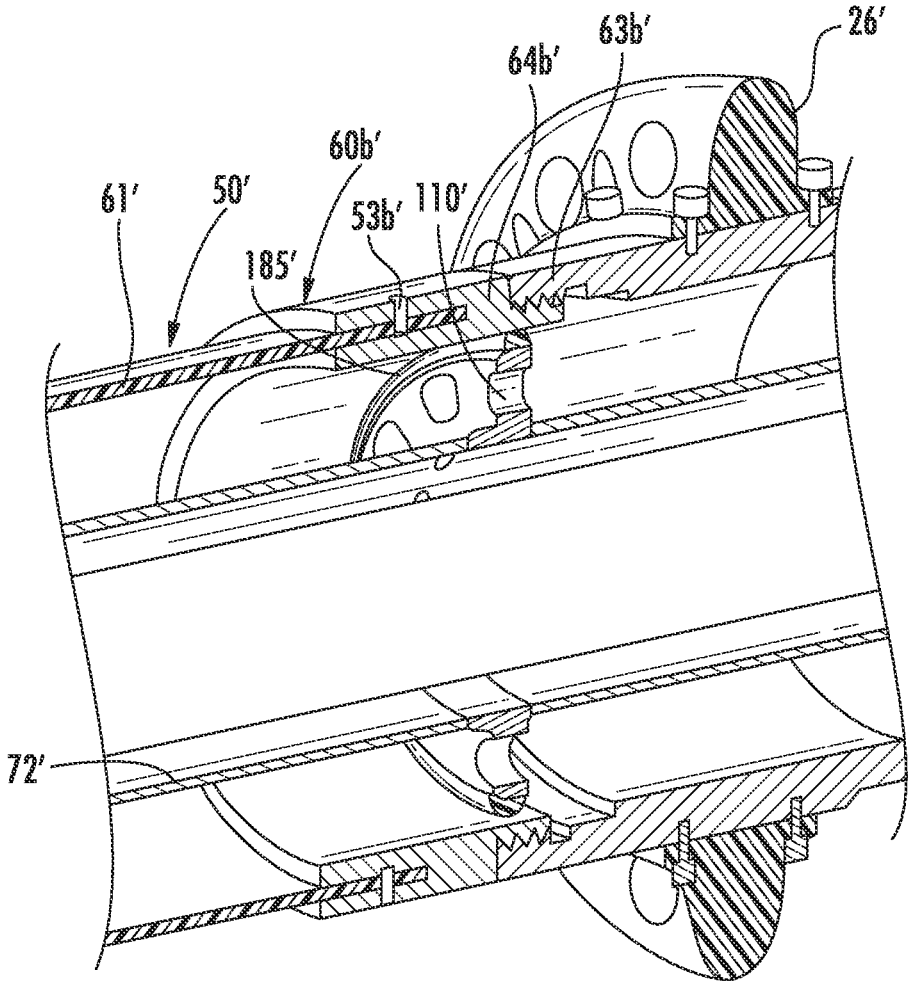
FIG. 8 is a cross-sectional view along line 8-8 of a coupling structure from the first set thereof from the antenna assembly of FIG. 7.
Figure 9:
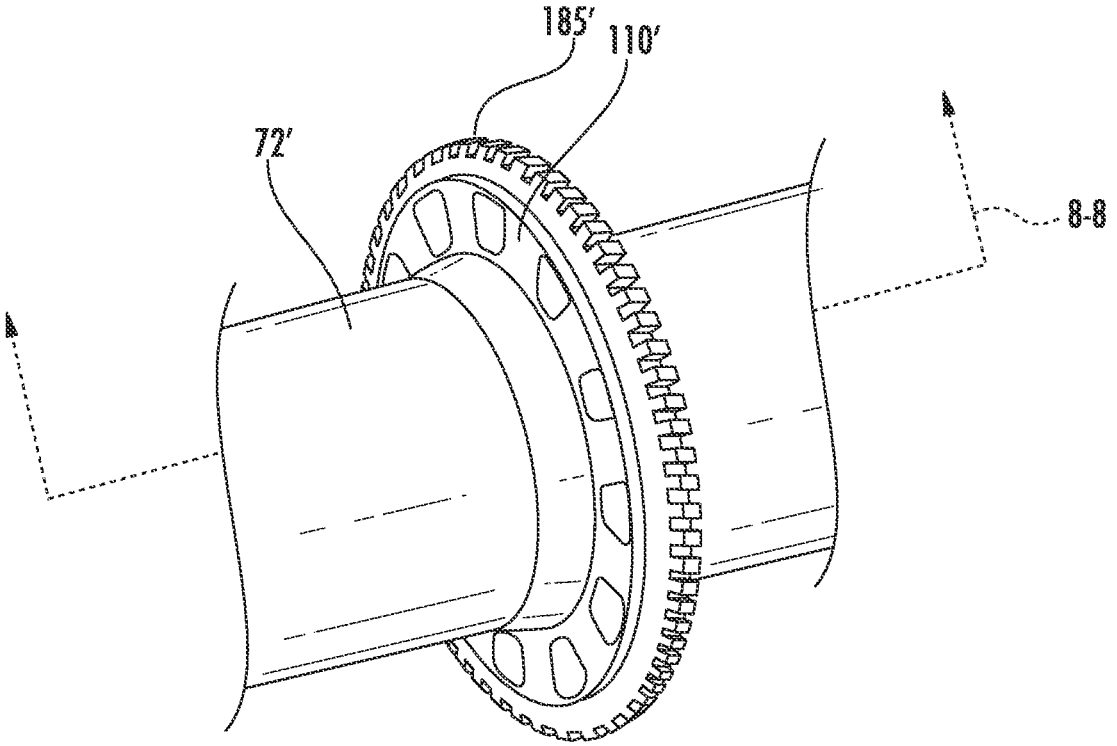
FIG. 9 is a perspective view of the coupling structure of FIG. 8 with the tubular conductor removed.

Referring now additionally to FIGS. 8-9, in the illustrated embodiment, each first set coupling structure 105'-106' comprises an electrically conductive support ring 110' surrounding the outer conductor 72' and being in the tap connector 60*b*' for coupling the outer conductor to the corresponding dipole element 103*a*'-103*b*'. Each first set coupling structure 105'-106' illustratively includes a circular finger stock 185' (e.g. beryllium copper (BeCu)) surrounding the electrically conductive support ring 110' and for providing a solid electrical coupling. As perhaps best seen in FIG. 9, the electrically conductive support ring 110' includes a plurality of passageways for permitting the flow of fluid therethrough.

Figure 10:
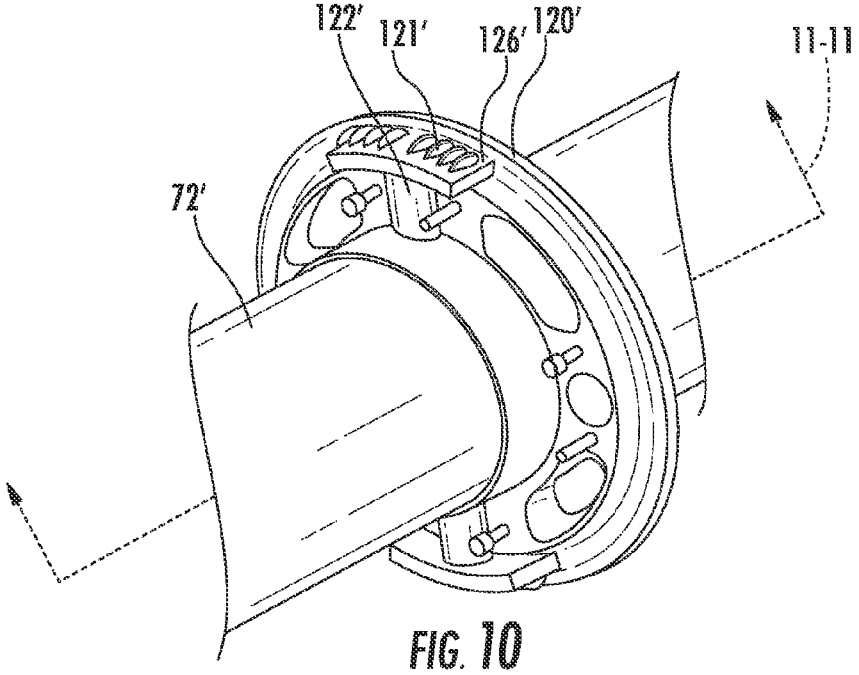
FIG. 10 is a perspective view of a coupling structure from the second set thereof from the antenna assembly of FIG. 7 with the tubular conductor removed.
Figure 11:
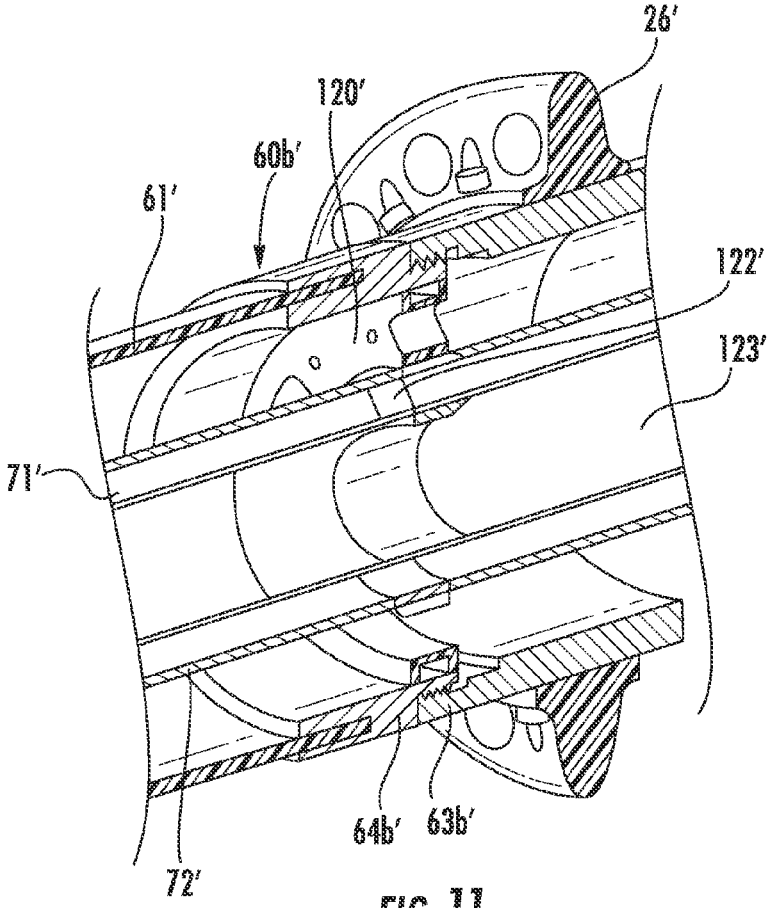
FIG. 11 is a cross-sectional view along line 11-11 of the coupling structure of FIG. 10.
Figure 12:
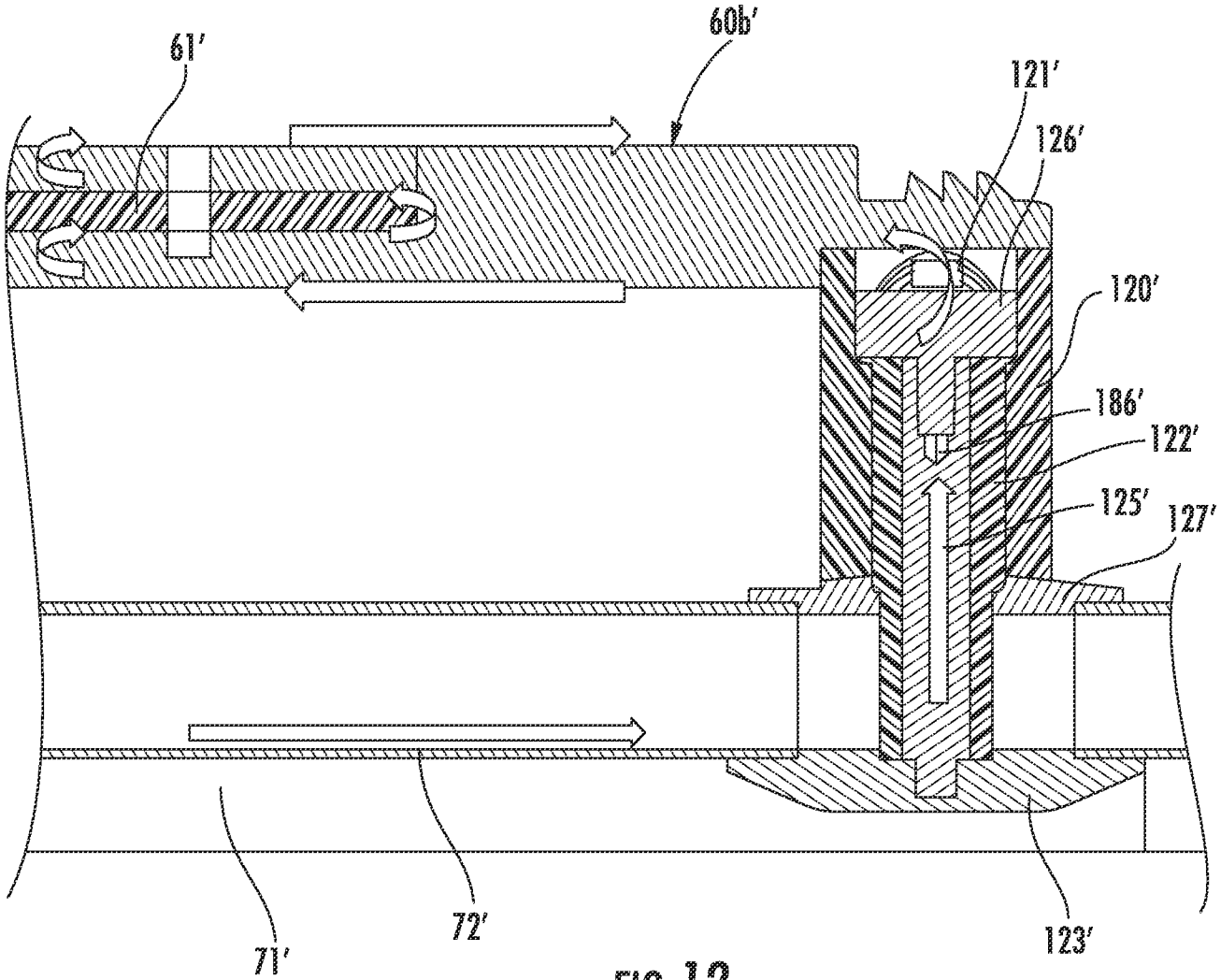
FIG. 12 is a cross-sectional view of a portion of the coupling structure of FIG. 10.
Figure 14A:
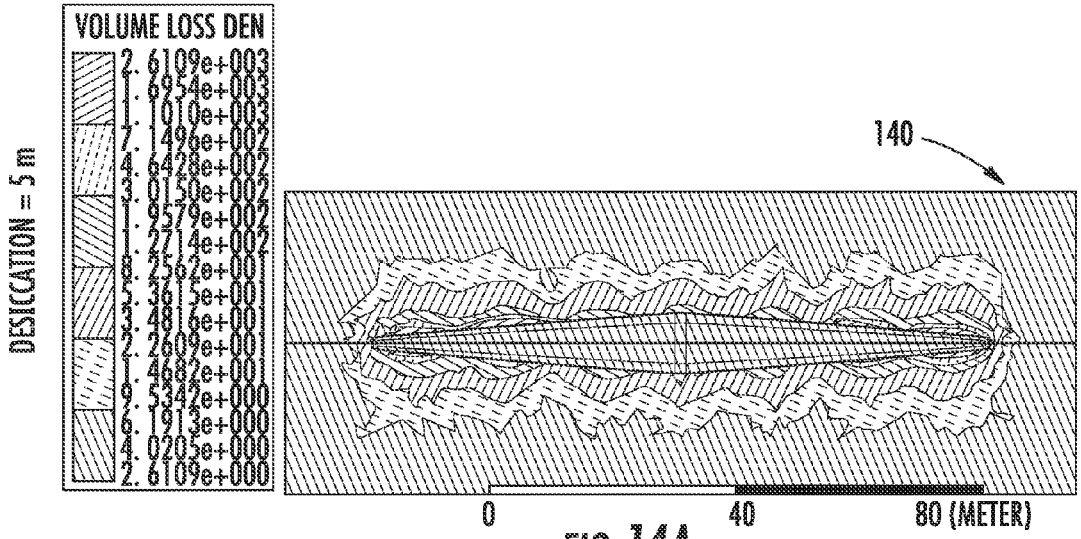
FIGS. 14A-14C are heating pattern diagrams of an example embodiment of the antenna assembly of FIG. 7.
Figure 14B:
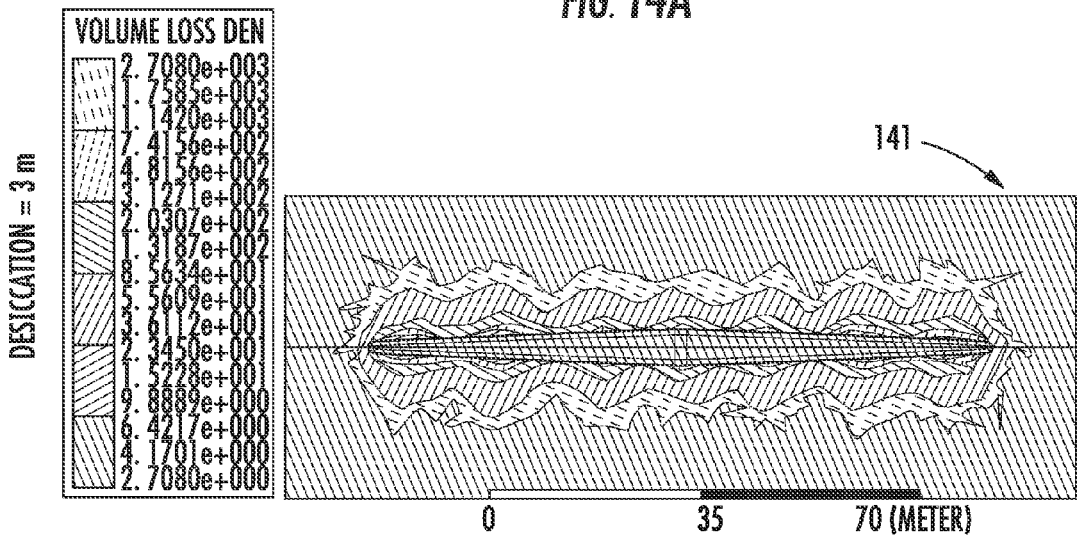
Figure 14C:
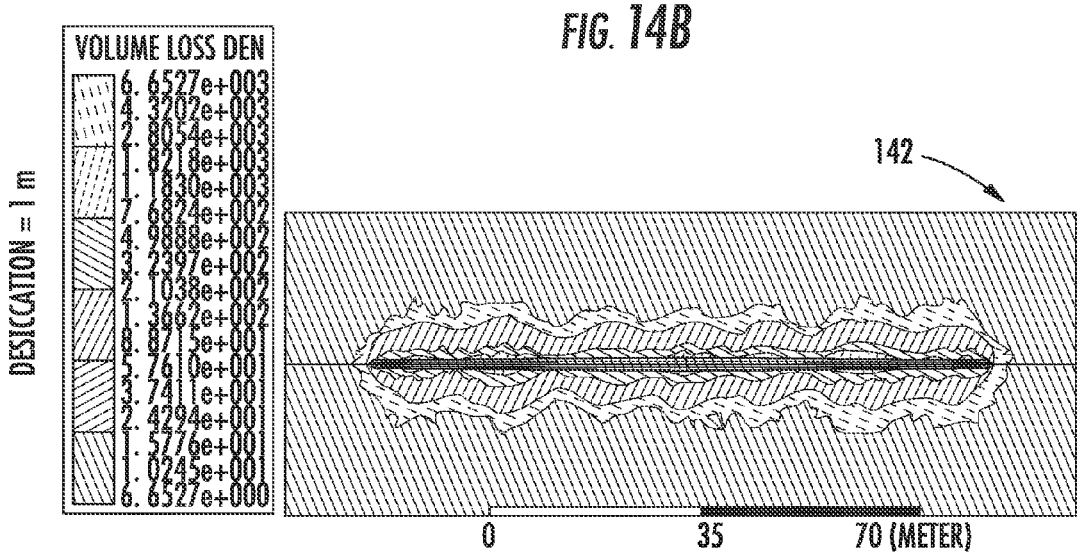
Figure 15A:
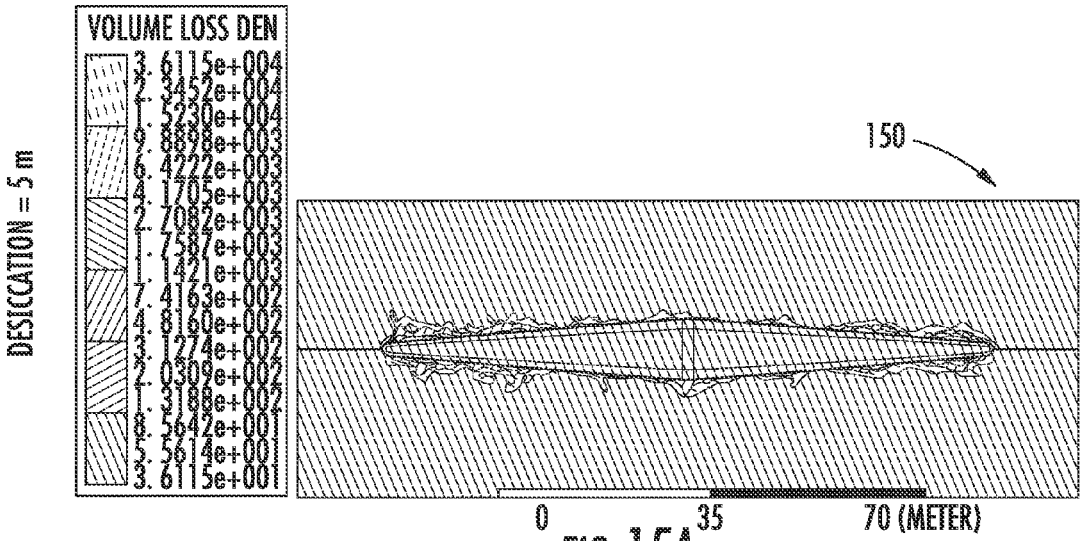
FIGS. 15A-15C are additional heating pattern diagrams of an example embodiment of the antenna assembly of FIG. 7 with varying conductivity and permittivity.
Figure 15B:
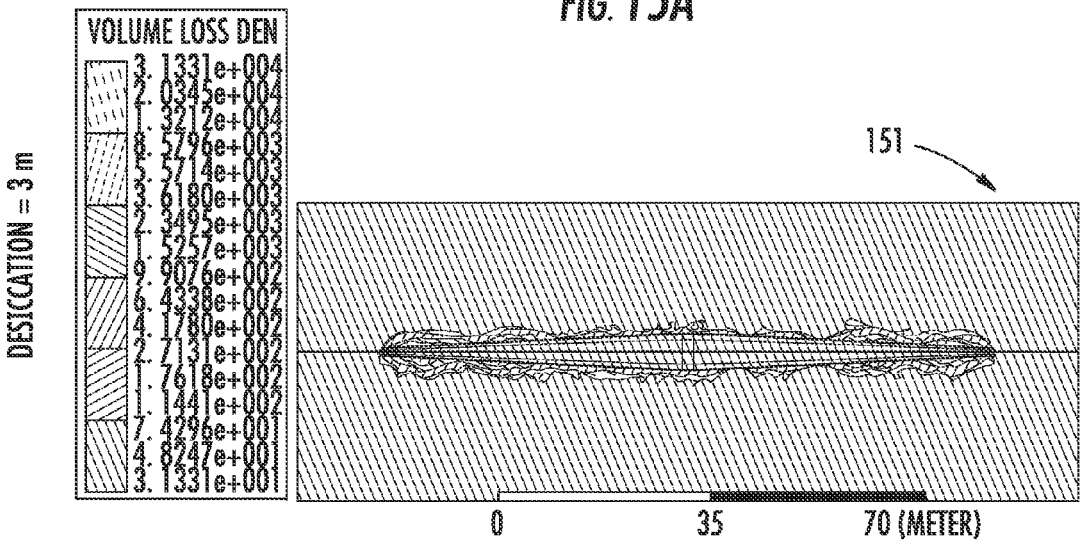
Figure 15C:
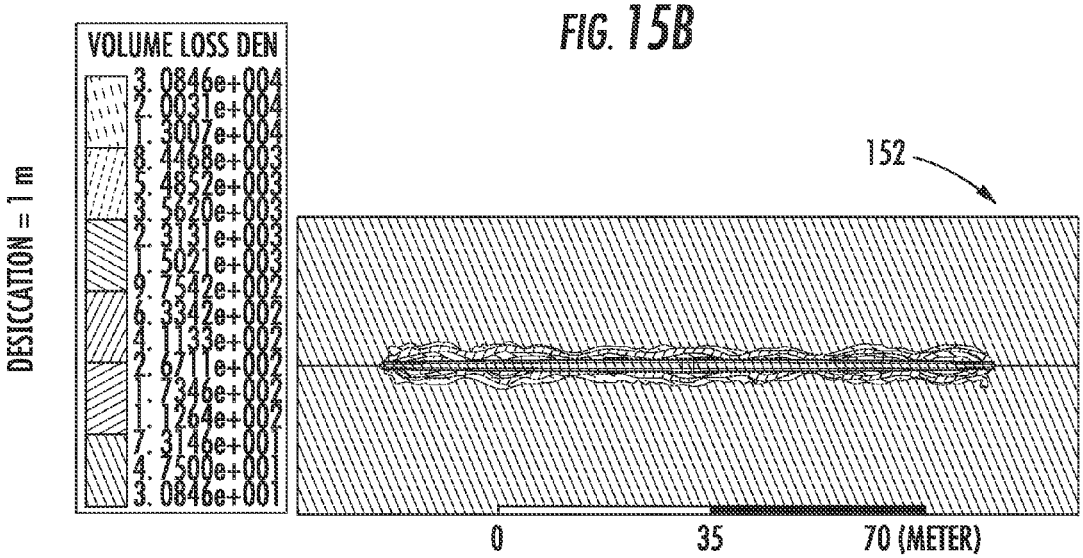

Referring now additionally to FIGS. 10-12, in the illustrated embodiment, each second set coupling structure 104', 107', 111' comprises a dielectric support ring 120' surrounding the outer conductor 72' and in the tap connector 60*b*', and an electrically conductive radial member 125' extending through the dielectric support ring and the outer conductor, and coupling the inner conductor 71' to the corresponding dipole element 102*a*'-102*c*'. Each second set coupling structure 104', 107', 111' illustratively includes a first circular conductive coupler 123' surrounding the inner conductor 71', and a second circular conductive coupler 127' surrounding the outer conductor 72'.

Each second set coupling structure 104', 107', 111' illustratively includes an insulating tubular member 122' surrounding the electrically conductive radial member 125' and insulating it from the outer conductor 72'. The insulating tubular member 122' is within the dielectric support ring 120'. Additionally, each second set coupling structure 104', 107', 111' illustratively includes a cap portion 126' having a finger stock 121' (e.g. beryllium copper (BeCu)) for providing a good electrical connection to the corresponding dipole element 102*a*'-102*c*', and a radial pin 186' extending therethrough for coupling the cap portion to the electrically conductive radial member 125' (also mechanically coupling the dielectric support ring 120' and the insulating tubular member 122' to the outer conductor). As shown, the path of the electrical current from the inner conductor 71' to the tap connector'60*b*' is noted with arrows.

Referring now additionally to FIGS. 13A-13C, the steps for assembling the second set coupling structure 104', 107', 111' includes coupling the second circular conductive coupler 127' to surround the outer conductor 72', and coupling the tubular member 122' to the outer conductor with the cap portion 126'. The dielectric support ring 120' comprises half portions that are assembled one at a time, and coupled together with fasteners. Also, the cap portion 126' allows the outer isolator to slide and thread into place while maintaining electrical contact.

Advantageously, the second set coupling structure 104', 107', 111' may allow for current and voltage transfer to the transducer element while maintaining coaxial transmission line 82' geometry, inner and outer conductor fluid paths 73', 85', coefficient of thermal expansion (CTE) growth of components, installation concept of operations (CONOPS) (i.e. torque/twisting), and fluid/gas path on exterior of transmission line. Also, the power tap size can be customized to limit current and voltage. In particular, the size and number of electrical "taps" result in a current dividing technique that supplies each antenna segment with the desired power. Also, the RF antenna assembly 24' provides flexibility in designing the number and radiation power of the antenna elements 102*a*'-102*c*', 103*a*'-103*b*'.

Also, the RF antenna assembly 24' allows for the formation of as many antenna segments as desired, driven from a single RF coaxial transmission line 82'. This makes for a selection of frequency independent of overall transducer length. Also, the RF antenna assembly 24' allows "power splitting" and tuning, by selection of the size and number of center conductor taps, and maintains coaxial transmission line 82' geometry, allowing the method for sequential building of the coax/antenna sections to be maintained. The RF antenna assembly 24' can be field assembled and does not require specific "clocking" of the antenna exterior with respect to the inner conductor "tap" points, assembly uses simple tools.

Furthermore, the RF antenna assembly 24' may permit sealing fluid flow to allow cooling fluid/gas and to allow for pressure balancing of the power node and antenna. The RF antenna assembly 24' accommodates differential thermal expansion for high temperature use, and utilizes several mechanical techniques to maintain high RF standoff distances. Also, RF antenna assembly 24' has multiple element sizes that can be arrayed together, allowing for the transducer to be driven at more than one frequency to account different subterranean environments along the length of the wellbore.

Additionally, the inner conductor 71' comprises a tube defining a first fluid passageway 85' therein, and the outer conductor 72' is spaced from the inner conductor to define a second fluid passageway 73'. Each dielectric tube 61' includes opposing open ends, and with opposing tap connectors 60*a*'-60*b*'. Each opposing tap connector 60*a*'-60*b*' is tubular and comprises a slotted recess 66*a*'-66*b*' receiving therein the respective opposing open end of the dielectric tube 61'. Also, each tubular opposing tap connector 60*a*'-60*b*' includes a threaded surface 86*a*'-86*b*' for engaging an opposing threaded end 63*a*'-63*b*' of the corresponding dipole element 102*a*'-102*c*', 103*a*'-103*b*', and a first plurality of tool-receiving recesses 65*a*-65*d* on a first outer surface thereof.

Another aspect is directed to a method of making a RF antenna assembly 24' operable to be positioned within a wellbore in a subterranean formation 27' for hydrocarbon resource recovery. The method comprises positioning a series of tubular dipole antennas 102*a*'-102*c*', 103*a*'-103*b*' within the wellbore, each tubular dipole antenna comprising a pair of dipole elements, positioning an RF transmission line 82' to extend within the series of tubular dipole antennas, and positioning a respective coupling structure 105'-107', 111' between each pair of dipole elements and between the series of tubular dipole antennas. Each coupling structure 105'-107', 111' comprises a dielectric tube 61' mechanically coupling adjacent dipole elements 102*a*'-102*c*', 103*a*'-103*b*', and at least one tap connector 60*a*'-60*b*' carried by the dielectric tube and electrically coupling the RF transmission line 82' to a corresponding dipole element.

Referring now to FIGS. 14A-15C, the heating pattern of the RF antenna assembly 24' is shown. Diagrams 140-142 show the heating pattern with $\in_r$=14, σ=0.003 S/m, and diagrams 150-152 show the heating pattern with $\in_r$=30, σ=0.05 S/m. Advantageously, the RF antenna assembly 24' collinear array configuration provides a uniform heating pattern along the axis of the array. Also, the football shaped desiccation region is based on heating patterns of a dipole antenna. For the sake of maximum uniformity between models, this desiccation shape was used for alternate antenna designs also. The actual shape of the desiccation region may be different.

Figure 16B:
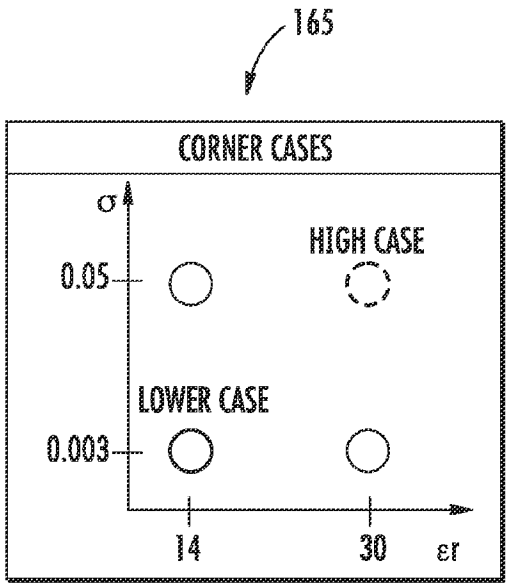
Figure 16A:
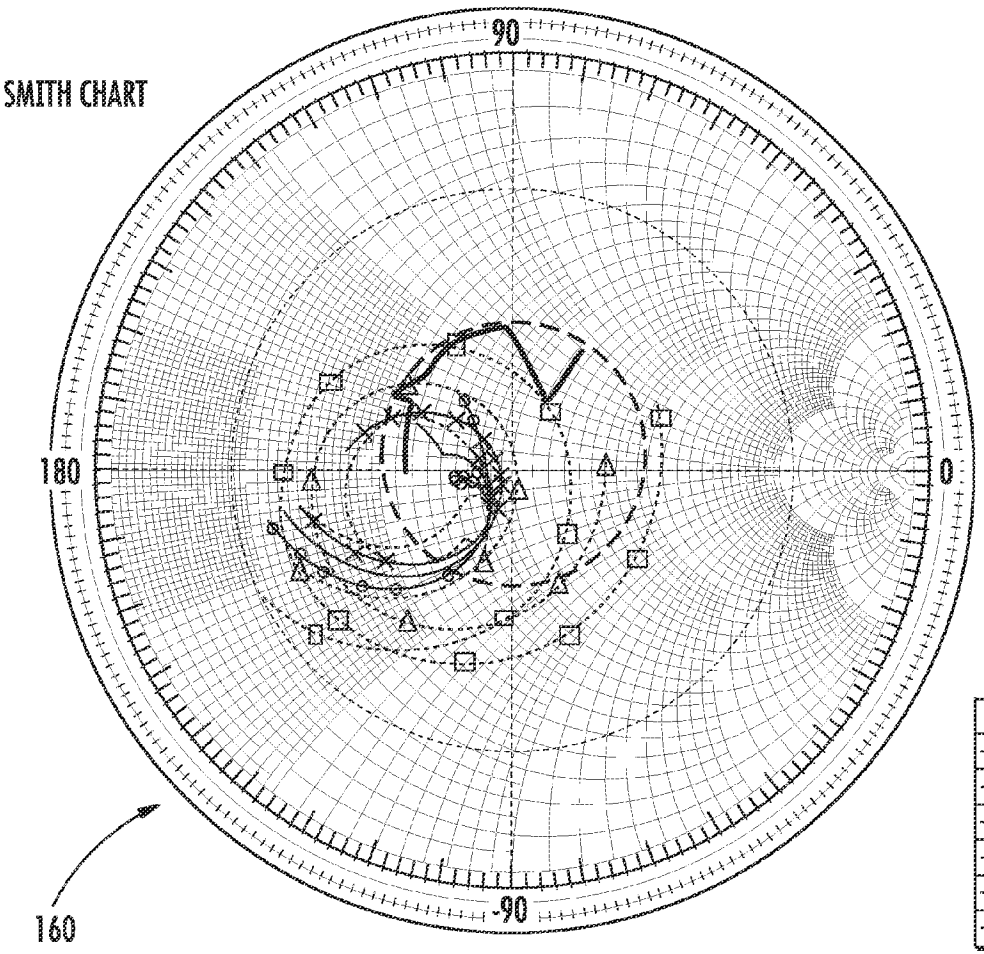

Referring now additionally to FIGS. 16A-16B, a Smith Chart 160 (Frequency Sweep: 5.2-5.4 MHz) and another associate diagram 165 illustrate performance of the RF antenna assembly 24'. Sensitivity: 1) Impedance is comparable to a dipole as the pay zone moves from saturation (solid with X mark, plain dashed line) to desiccation (solid line with circle, and dashed line with square mark). 2) Impedance is managed over the pay zone corner cases for low and high $\in_r$ and σ.

TABLE 1

Data Points for Smith Chart (FIG. 16A)

| Name | Freq | Ang | Mag | RX |
|---|---|---|---|---|
| m1 | 5.8791 | −154.5753 | 0.0892 | 0.8485 − 0.0655i |
| m2 | 6.1761 | 1.1308 | 0.1360 | 1.3148 + 0.0072i |
| m3 | 5.8667 | −151.6645 | 0.0715 | 0.8797 − 0.0600i |
| m4 | 6.1885 | 3.0302 | 0.0062 | 1.0124 + 0.0007i |
| m5 | 5.8667 | −159.9952 | 0.0345 | 0.9369 − 0.0222i |
| m6 | 6.1390 | 173.9086 | 0.0559 | 0.8947 + 0.0106i |

Other features relating to RF antenna assemblies are disclosed in co-pending applications: titled "RF ANTENNA ASSEMBLY WITH FEED STRUCTURE HAVING DIELECTRIC TUBE AND RELATED METHODS," U.S. Patent Publication No. 2014/0262224 published Sep. 18, 2014; and titled "RF ANTENNA ASSEMBLY WITH SERIES DIPOLE ANTENNAS AND COUPLING STRUCTURE AND RELATED METHODS," U.S. Pat. No. 9,181,787 issued Nov. 10, 2015, all incorporated herein by reference in their entirety.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) antenna assembly configured to be positioned within a wellbore in a subterranean formation for hydrocarbon resource recovery, the RF antenna assembly comprising:

first and second tubular conductors and a dielectric isolator therebetween;

said dielectric isolator comprising a dielectric tube having opposing first and second open ends, a first tubular connector comprising a first slotted recess receiving therein the first open end of said dielectric tube, a second tubular connector comprising a second slotted recess receiving therein the second open end of said dielectric tube, and adhesive securing said first and second tubular connectors to the respective first and second open ends.

2. The RF antenna assembly of claim 1 wherein said dielectric tube has a first plurality of passageways therein adjacent the first open end and through the first slotted recess, and a second plurality of passageways therein adjacent the second open end and through the second slotted recess.

3. The RF antenna assembly of claim 2 wherein said first tubular connector has a first plurality of blind openings therein aligned with the first plurality of passageways; and wherein said second tubular connector has a second plurality of blind openings therein aligned with the second plurality of passageways.

4. The RF antenna assembly of claim 3 further comprising a first plurality of pins extending through said first pluralities of passageways and blind openings, and a second plurality of pins extending through said second pluralities of passageways and blind openings.

5. The RF antenna assembly of claim 1 wherein said first tubular connector has a first threaded surface for engaging an opposing threaded end of said first tubular conductor; and wherein second tubular connector has a second threaded surface for engaging an opposing threaded end of said second tubular conductor.

6. The RF antenna assembly of claim 1 wherein said first tubular connector has a first plurality of tool-receiving recesses on a first outer surface thereof; and wherein said second tubular connector has a second plurality of tool-receiving recesses on a second outer surface thereof.

7. The RF antenna assembly of claim 1 wherein said dielectric tube comprises cyanate ester composite material.

8. The RF antenna assembly of claim 1 wherein said dielectric isolator further comprises at least one inner conductor extending within said dielectric tube.

9. A radio frequency (RF) antenna assembly configured to be positioned within a wellbore in a subterranean formation for hydrocarbon resource recovery, the RF antenna assembly comprising:

first and second tubular conductors and a dielectric isolator therebetween;

said dielectric isolator comprising a dielectric tube having opposing first and second open ends, a first tubular connector comprising a first slotted recess receiving therein the first open end of said dielectric tube, a second tubular connector comprising a second slotted recess receiving therein the second open end of said dielectric tube, said dielectric tube having a first plurality of passageways therein adjacent the first open end and through the first slotted recess, and a second plurality of passageways therein adjacent the second open end and through the second slotted recess, said first tubular connector having a first plurality of blind openings therein aligned with the first plurality of passageways, said second tubular connector having a second plurality of blind openings therein aligned with the second plurality of passageways, and adhesive material extending through said first pluralities of passageways and blind openings, and said second pluralities of passageways and blind openings.

10. The RF antenna assembly of claim 9 further comprising a first plurality of pins in said adhesive material and extending through said first pluralities of passageways and blind openings, and a second plurality of pins in said adhesive material and extending through said second pluralities of passageways and blind openings.

11. The RF antenna assembly of claim 9 further comprising additional adhesive securing said first and second tubular connectors to the respective first and second open ends.

12. The RF antenna assembly of claim 9 wherein said first tubular connector has a first threaded surface for engaging an opposing threaded end of said first tubular conductor; and wherein second tubular connector has a second threaded surface for engaging an opposing threaded end of said second tubular conductor.

13. The RF antenna assembly of claim 9 wherein said first tubular connector has a first plurality of tool-receiving recesses on a first outer surface thereof; and wherein said second tubular connector has a second plurality of tool-receiving recesses on a second outer surface thereof.

14. A method of assembling a radio frequency (RF) antenna assembly within a wellbore in a subterranean formation for hydrocarbon resource recovery, the method comprising:

coupling first and second tubular conductors and a dielectric isolator therebetween, the dielectric isolator comprising a dielectric tube having opposing first and second open ends, a first tubular connector comprising a first slotted recess receiving therein the first open end of the dielectric tube, and a second tubular connector comprising a second slotted recess receiving therein the second open end of the dielectric tube; and securing with adhesive the first and second tubular connectors to the respective first and second open ends.

15. The method of claim 14 further comprising forming a first plurality of passageways in the dielectric tube adjacent the first open end and through the first slotted recess, and forming a second plurality of passageways in the dielectric tube adjacent the second open end and through the second slotted recess.

16. The method of claim 15 further comprising:

aligning a first plurality of blind openings in the first tubular connector with the first plurality of passageways; and aligning a second plurality of blind openings in the second tubular connector with the second plurality of passageways.

17. The method of claim 16 further comprising:

positioning a first plurality of pins extending through the first pluralities of passageways and blind openings; and positioning a second plurality of pins extending through the second pluralities of passageways and blind openings.

18. The method of claim 14 further comprising:

engaging a first threaded surface of the first tubular connector with an opposing threaded end of the first tubular conductor; and engaging a second threaded surface of the second tubular connector with an opposing threaded end of the second tubular conductor.

19. The method of claim 14 further comprising positioning at least one inner conductor extending within the dielectric tube.

20. A method of assembling a radio frequency (RF) antenna assembly within a wellbore in a subterranean formation for hydrocarbon resource recovery, the method comprising:

coupling first and second tubular conductors and a dielectric isolator therebetween, the dielectric isolator comprising a dielectric tube having opposing first and second open ends, a first tubular connector comprising a first slotted recess receiving therein the first open end of the dielectric tube, and a second tubular connector comprising a second slotted recess receiving therein the second open end of the dielectric tube;

forming a first plurality of passageways in the dielectric tube adjacent the first open end and through the first slotted recess, and forming a second plurality of passageways in the dielectric tube adjacent the second open end and through the second slotted recess;

aligning a first plurality of blind openings in the first tubular connector with the first plurality of passageways;

aligning a second plurality of blind openings in the second tubular connector with the second plurality of passageways; and forming adhesive material extending through the first pluralities of passageways and blind openings, and the second pluralities of passageways and blind openings.

21. The method of claim 20 further comprising:

positioning a first plurality of pins in the adhesive material and extending through the first pluralities of passageways and blind openings; and positioning a second plurality of pins in the adhesive material and extending through the second pluralities of passageways and blind openings.

22. The method of claim 20 further comprising:

engaging a first threaded surface of the first tubular connector with an opposing threaded end of the first tubular conductor; and engaging a second threaded surface of the second tubular connector with an opposing threaded end of the second tubular conductor.

23. A radio frequency (RF) antenna assembly configured to be positioned within a wellbore in a subterranean formation for hydrocarbon resource recovery, the RF antenna assembly comprising:

first and second tubular conductors and a dielectric isolator therebetween;

said dielectric isolator comprising a dielectric tube having opposing first and second open ends, a first tubular connector comprising a first slotted recess receiving therein the first open end of said dielectric tube, a second tubular connector comprising a second slotted recess receiving therein the second open end of said dielectric tube, said dielectric tube having a first plurality of passageways therein adjacent the first open end and through the first slotted recess, and a second plurality of passageways therein adjacent the second open end and through the second slotted recess, said first tubular connector having a first plurality of blind openings therein aligned with the first plurality of passageways, said second tubular connector has a second plurality of blind openings therein aligned with the second plurality of passageways, and a first plurality of pins extending through said first pluralities of passageways and blind openings, and a second plurality of pins extending through said second pluralities of passageways and blind openings, each first and second pin defining an axial passageway.

24. The RF antenna assembly of claim 23 wherein said first tubular connector has a first threaded surface for engaging an opposing threaded end of said first tubular conductor; and wherein second tubular connector has a second threaded surface for engaging an opposing threaded end of said second tubular conductor.

25. The RF antenna assembly of claim 23 wherein said first tubular connector has a first plurality of tool-receiving recesses on a first outer surface thereof; and wherein said second tubular connector has a second plurality of tool-receiving recesses on a second outer surface thereof.

26. A method of assembling a radio frequency (RF) antenna assembly within a wellbore in a subterranean formation for hydrocarbon resource recovery, the method comprising:

coupling first and second tubular conductors and a dielectric isolator therebetween, the dielectric isolator comprising a dielectric tube having opposing first and second open ends, a first tubular connector comprising a first slotted recess receiving therein the first open end of the dielectric tube, and a second tubular connector comprising a second slotted recess receiving therein the second open end of the dielectric tube;

forming a first plurality of passageways in the dielectric tube adjacent the first open end and through the first slotted recess, and forming a second plurality of passageways in the dielectric tube adjacent the second open end and through the second slotted recess;

aligning a first plurality of blind openings in the first tubular connector with the first plurality of passageways;

aligning a second plurality of blind openings in the second tubular connector with the second plurality of passageways;

positioning a first plurality of pins extending through the first pluralities of passageways and blind openings; and positioning a second plurality of pins extending through the second pluralities of passageways and blind openings, each first and second pin defining an axial passageway.

27. The method of claim 26 further comprising:

engaging a first threaded surface of the first tubular connector with an opposing threaded end of the first tubular conductor; and engaging a second threaded surface of the second tubular connector with an opposing threaded end of the second tubular conductor.

28. The method of claim 26 wherein the first tubular connector has a first plurality of tool-receiving recesses on a first outer surface thereof; and wherein the second tubular connector has a second plurality of tool-receiving recesses on a second outer surface thereof.

* * * * *